US006136449A

United States Patent [19]

Furuuchi et al.

[11] Patent Number: 6,136,449

[45] Date of Patent: Oct. 24, 2000

[54] METHOD FOR FORMING A PAINT FILM, AND A PAINTED OBJECT

[75] Inventors: Kazuyoshi Furuuchi; Souichi Mori, both of Yokohama, Japan

[73] Assignee: BASF Coatings AG, Muenster-Hiltrup, Germany

[21] Appl. No.: 09/091,631

[22] PCT Filed: Nov. 22, 1996

[86] PCT No.: PCT/EP96/05159

§ 371 Date: Jun. 19, 1998

§ 102(e) Date: Jun. 19, 1998

[87] PCT Pub. No.: WO97/22420

PCT Pub. Date: Jun. 26, 1997

[30] Foreign Application Priority Data

Dec. 19, 1995 [JP] Japan ..... H7-330838

[51] Int. Cl.[7] ..... B05D 1/36

[52] U.S. Cl. ..... 428/500; 427/407.1; 427/409; 428/424.2; 428/414; 428/515

[58] Field of Search ..... 427/407.1, 409; 428/515, 500, 424.2, 414

[56] References Cited

U.S. PATENT DOCUMENTS

| | | | |
|---|---|---|---|
| 3,959,202 | 5/1976 | Blank | 427/388.3 |
| 4,424,240 | 1/1984 | Kielbania, Jr. | 427/393.5 |
| 4,490,417 | 12/1984 | Shindow et al. | 427/407.1 |
| 4,499,150 | 2/1985 | Dowbenko et al. | 428/447 |
| 4,603,064 | 7/1986 | Kania | 427/407.1 |
| 4,781,949 | 11/1988 | Kasari | 427/407.1 |
| 4,812,335 | 3/1989 | Kuwajima et al. | 427/407.1 |
| 5,100,962 | 3/1992 | Sawada et al. | 525/125 |
| 5,279,862 | 1/1994 | Corcoran et al. | 427/407.1 |
| 5,585,146 | 12/1996 | Uenaka et al. | 427/407.1 |

FOREIGN PATENT DOCUMENTS

| | | |
|---|---|---|
| 0 217 385 A2 | 1/1986 | European Pat. Off. . |
| 0 630 923 A2 | 6/1994 | European Pat. Off. . |
| 0 653 468 A2 | 8/1994 | European Pat. Off. . |
| 0 653 468 A3 | 8/1994 | European Pat. Off. . |
| 43 41 235 A1 | 3/1993 | Germany . |
| 195 29 124 C1 | 8/1995 | Germany . |
| 2 172 292 | 9/1986 | United Kingdom . |

OTHER PUBLICATIONS

WO9409916 A; (BASF Lacke & Farben); Shibato Kishio (JP); Kawamura Masataka; May 11, 1994(see whole document).

Database WPI sec. Ch., Week 9527, Derwent Publications Ltd., London, GB; AN 95–204098 XPoo2o26639 (No month, date).

Database WPI sec. Ch., Week 9527, Derwent Publications Ltd., London, GB; Cladd A14, AN 95–363057 (No month, date).

*Primary Examiner*—Diana Dudash

[57] ABSTRACT

To form paint films of outstanding acid resistance, finished appearance, water resistance, adhesion and bending resistance by coating a base finishing coat and top finishing coat wet-on-wet.

A method for forming a paint film by a method for forming a thermosetting paint film in which a solvent-based thermosetting base finishing coat is painted onto the surface of an object to be painted, a thermosetting top finishing coat is painted on top of this wet-on-wet, and the paint films are hardened at the same time, in which the aforementioned top finishing coat which contains as a primary resin a copolymer which is a copolymer of a vinyl monomer which has a ring structure and other vinyl monomers in which the proportion of vinyl monomer having a ring structure in the total quantity of monomers is 20–50 wt %, and the proportion of other vinyl monomer(s) is 80–50 wt %, and which has a glass transition temperature of 0–60° C., a solubility parameter of 9.0–11.0 and a weight-average molecular weight of 4000–30,000.

7 Claims, No Drawings

METHOD FOR FORMING A PAINT FILM, AND A PAINTED OBJECT

BACKGROUND OF THE INVENTION

The present invention relates to a method for applying a base finishing coat and a top finishing coat wet-on-wet on to a substrate surface to form a thermosetting paint film, and to painted objects obtained by this means. More specifically, the present invention relates to a method for forming thermosetting paint films of outstanding acid resistance, finished appearance, water-resistance, adhesion and bending resistance, etc., suitable for finishing coat paint films, and painted objects obtained by this means.

PRIOR ART

Thermosetting paints which form a hardened paint film by applying a base finishing coat and top finishing coat wet-on-wet and stoving the resulting paint films at the same time are widely used as finishing coats for painting the outer skins of automobiles. However, the fact that top finishing coat paint films are prone to water staining by acid rain of low pH due to atmospheric pollution, which lowers their appearance, has become a problem in recent years.

In order to solve this problem, paint compositions with increased water resistance due to crosslinking of the principal resin of the top finishing coat with a hardener to form a composite, etc., have been investigated: for example, in Japanese Unexamined Patent 3-275780 paint compositions are proposed in which the principal components are an acrylic resin containing hydroxyl groups and carboxyl groups, an acrylic resin containing hydroxyl groups and epoxy groups, an amino resin and a quaternary phosphonium salt.

However, if the concentration of carboxyl groups and epoxy groups in such paint compositions is increased in order to obtain a high degree of acid resistance, the finished appearance of the paint film is lowered; and raising the glass transition temperature of the hardened paint film invites decreases in recoat adhesion and bending resistance. Thus, it is extremely difficult to obtain finishing coat paint films which have acid resistance and finished appearance balanced at a high level, and have outstanding adhesion resistance and bending resistance by painting prior finishing coats.

The purpose of the present invention is to solve this problem by offering a method for forming a paint film which can form hardened paint films with outstanding acid resistance, finished appearance, water resistance, adhesion, and bending resistance, etc., in forming a paint film by painting a base finishing coat and a top finishing coat painted wet-on-wet, and offering painted objects obtained with this method.

SUMMARY OF THE INVENTION

The present invention provides the following method for forming a paint film, and painted objects.

(1) A method for forming a paint film, which is a method for forming a hardened paint film in which a solvent-based thermosetting base finishing coat is painted onto the surface of an object to be painted, a thermosetting top finishing coat is painted on top of this wet-on-wet, and the resulting paint films are hardened at the same time, characterized in that the aforementioned top finishing coat contains as the principal resin a copolymer which is a copolymer of a vinyl monomer which has a ring structure and (an)other vinyl monomer(s) in which the proportion of vinyl monomers having a ring structure in the total quantity of monomers is 20–50 wt %, and the proportion of other vinyl monomer(s) is 80–50 wt %, and which has a glass transition temperature of 0–60° C., a solubility parameter of 9.0–11.0, and a weight-average molecular weight of 4000–30,000.

(2) A method for forming a paint film according to (1), characterized in that the base finishing coat contains as the principal resin a resin which has a glass transition temperature of −50 to +40° C., a solubility parameter of 10.0–12.0 and a surface tension of 30–50 mN/m.

(3) Painted objects obtained by the method of (1) above.

DETAILED DESCRIPTION OF THE INVENTION

The glass transition temperatures (Tg) in the present invention are values found by Equation (1) below, of T. G. Fox (*Bull. Am. Phys. Soc.* No. 3, 123 (1956)).

$$1/Tg=\Sigma(wn/Tgn) \quad (1)$$

(Where n indicates a natural number representing the number of monomers, wn indicates the wt % of the nth monomer, and Tgn indicates the Tg of a homopolymer of the nth monomer.)

The solubility parameters in the present invention are values found by means of Equation (2) below, by Fedors' method (*Polymer Engineering and Science* 14 (2) (February 1974).

$$Sp\text{値} = \left\{\frac{\sum(\Delta e_1)}{\sum(\Delta v_1)}\right\}^{1/2} \quad (2)$$

(Where $\Delta e_1$ is the cohesive energy per unit functional group, and $\Delta v_1$ molecular value per unit functional group.)

Surface tensions in the present invention are values determined by the following method.

1) The resin varnish is sampled into a brick dish, and the solvent is eliminated by heating at 150° C. for 20 minutes.

2) 10 g of resin from which solvent has been removed in 1) above is dissolved in 10 g of N-methylpyrrolidone, to give the sample for determination.

3) The surface tension of the sample of 2) above is determined by the ring method, with the maximum value being taken as the surface tension.

The weight-average molecular weights (Mw) in the present invention are values determined by gel permeation chromatography against a polystyrene standard.

The base finishing coat used in the present invention is a solvent-based thermosetting paint. There are no restrictions as to this solvent-based thermosetting paint, and prior solvent-based base finishing coats can be used as they stand; however, it is desirable to use a base finishing coat which includes as the principal resin a resin of a glass transition temperature (Tg) of −50 to +40° C., and preferably −45 to +40° C., and more preferably −42 to +40° C. With a glass transition temperature of less than 50° C. the gasoline resistance of the paint film is lowered, and more than 40° C. is undesirable because recoat adhesion is lowered.

Similarly, it is desirable to employ a base finishing coat which includes as the principal resin a resin of a solubility parameter of 10.0–12.0, and preferably 10.0–11.8, and more preferably 10.0–11.5. When the solubility parameter is less than 10.0 the phenomenon of mingling is produced due to phase solubility between the base finishing coat and top finishing coat when it is wet-on-wet with the top finishing coat, and appearance is lowered; and more than 12.0 is undesirable because water resistance is lowered.

Moreover, it is desirable to employ a base finishing coat which includes as the principal resin a resin of a surface tension or 30–50 mN/m, and preferably 30–45 mN/m, and more preferably 35–45 mN/m. When the surface tension is less than 30 mN/m appearance is lowered due to the phenomenon of mingling, and more than 50 mN/m is undesirable because appearance is lowered by poor wetting with the middle coat, and adhesion between the base finishing coat and the top finishing coat is lowered.

There are no specific restrictions as to the type of principal resin of the base finishing coat, and all resins employed as principal resins in prior wet-on-wet base finishing coats can be employed, such as acrylic resins, alkyd resins, polyester resins and urethane resins, etc.; however, those employed in painting automobiles are particularly preferred.

There are no specific restrictions as to the mode of curing the base finishing coat: i.e. the combination of principal resin and hardener, and a hydroxyl-group-containing resin/melamine resin system, hydroxyl-group-containing resin/isocyanate system, hydroxyl-group-containing resin/blocked isocyanate system, carboxyl-group-containing resin/epoxy system, epoxy-group-containing resin/carboxyl-group-containing resin, or silicone crosslinking, etc., for example, can be used; however, a system used in painting automobiles is particularly preferred. These modes can be used on their own, or in combinations of 2 or more.

Melamine resins as aforementioned hardeners include butylated melamine resins, methylated melamine resins and mixed butylated/methylated ether melamine resins, etc., obtained by methylolation of aminotriazine, and alkylating with cyclohexanol or a C1–6 alkanol. Concrete examples of butylated melamine resins include Yuban (trade name Mitsui Toatsu Chemical) and Superbeckamin (trade name Dainippon Ink & Chemical Industry); concrete examples of methyl ether melamine resins and butyl/methyl ether melamine resins include Cymel (trade name Mitsui Cyamid) and Nikalac (trade name Sanwa Chemical), etc.

Examples of isocyanate or blocked isocyanates which can be employed as aforementioned hardeners include polyisocyanate compounds such as hexamethylene diisocyanate, trimethylhexamethylene diisocyanate, isophorone diisocyanate, hydrogenated diphenylmethane diisocyanate and hydrogenated xylylene diisocyanate, etc., and adduct forms, biurets and polyisocyanurates thereof, for example, and these compounds blocked with a blocking agent, such as a compound containing active hydrogen, including phenol and phenols such as m-cresol, xylenol and thiophenol, etc., alcohols such as methanol, ethanol, butanol, 2-ethylhexanol and cyclohexanol, etc., caprolactam, methyl ethyl ketone oxime, ethyl acetoacetate and diethyl malonate, etc.

Examples of epoxy compounds which can be employed as aforementioned hardeners include compounds containing epoxy groups, such as bisphenolic epoxy resins, alicyclic epoxy resins, homopolymers and copolymers of glycidyl (meth)acrylate or 3-4-epoxycyclohexylmethyl (meth) acrylate, etc., and polyglycidyl compounds obtained by reacting a polycarboxylic acid or polyol with epichlorhydrin, etc.

Examples of carboxyl-group-containing resins which can be employed as aforementioned hardeners include (1) partial esters of a polyol having at least 2, and preferably 2–50, hydroxyl groups per molecule and an acid anhydride, (2) addition compounds of a polyisocyanate having at least 2, and preferably 2–50, isocyanate groups per molecule with a hydroxycarboxylic acid or amino acid, (3) homopolymers of carboxyl-group-containing α,β-unsaturated monomers and copolymers with other α,β-unsaturated monomer(s), and (4) polyester resins having a terminal carboxyl group, etc.

For aforementioned silicone crosslinking, vinyl polymers which contain silyl groups, in which the main chain comprises substantially a vinyl polymer, with at least 1 silicon atom per molecule bound terminally or in a side chain to a hydrolysable moiety, can be employed; the Kanegafuchi Chemical Industry product Zemlac (trade name) can be given as an example.

Colored pigments, metallic pigments, polymers such as cellulosic polymers and crosslinked polymer particles, etc., and additives employed in prior paint, including viscosity adjusting agents, sag preventing agents, levelling agents, hardening catalysts, pigment dispersants, gel-preventing agents, ultraviolet absorbers and free radical scavengers, etc., can also optionally be added to the base finishing coat used in the present invention, within ranges that do not detract from the purpose of the present invention.

There are no particular restrictions regarding metallic pigments above, and those used in ordinary paint can be employed; examples include surface-treated aluminum, copper, brass, bronze and stainless steel, etc., or micaceous iron oxide, leafing aluminum powder and mica flakes coated with titanium oxide or iron oxide, etc.

There are also no particular restrictions regarding colored pigments above, and those employed in ordinary paint can be employed; examples include inorganic pigments such as titanium oxide, bengala, yellow iron oxide and carbon black, etc., and organic pigments such as phthalocyanine blues, phthalocyanine greens, quinacridone red pigments and isoindolinone yellow pigments, etc.

The principal resin of the top finishing coat employed in the present invention is a copolymer of a vinyl monomer having a ring structure and other vinyl monomers, and is ordinarily obtained by free radical copolymerization of these monomers.

Vinyl monomers having a ring structure are monomers which have a mononuclear or polynuclear aromatic, alicyclic and/or heterocyclic ring structure and a vinyl group. The ring can be substituted with substituent groups. Other vinyl monomers are monomers which have a vinyl group but do not have a ring structure above.

Examples of monomers which have a ring structure above include styrene, cyclohexyl (meth)acrylate, isobornyl (meth) acrylate, tetracyclo[$4.4.0.1^{2,9}.1^{7,10}$]-dodecyl-3-(meth) acrylate, adamantyl (meth)acrylate, t-butylcyclohexyl (meth)acrylate, and 2-(meth) acryloyloxyethylhexahydrophthalic acid, etc. These can be employed singly or employed in combinations of 2 or more.

Examples of other vinyl monomers which copolymerize with vinyl monomers which have a ring structure include (meth)acrylates such as methyl (meth)acrylate, ethyl (meth) acrylate, propyl (meth)acrylate, n-butyl (meth)acrylate, isobutyl (meth)acrylate, tert-butyl (meth)acrylate, 2-ethylhexyl (meth)acrylate, stearyl (meth)acrylate and dodecyl (meth)acrylate, etc., vinyl monomers which include a carboxyl group, such as acrylic acid, methacrylic acid, ethacrylic acid, propylacrylic acid, isopropylacrylic acid, crotonic acid, maleic acid, itaconic acid, maleic acid monoesters, itaconic acid monoesters and acrylic acid dimer, etc., lactone-modified vinyl monomers, such as acrylic acid ε-caprolactone addition products, methacrylic acid ε-caprolactone addition products and 2-hydroxyethyl (meth) acrylate ε-caprolactone addition products, etc., monoesters of vinyl groups which include a hydroxyl group, such as 2-hydroxyethyl (meth)acrylate, 2-hydroxypropyl (meth)

acrylate, 3-hydroxypropyl (meth)acrylate, 4-hydroxybutyl (meth)acrylate and glycerol (meth)acrylate, etc., and acid anhydrides such as succinic anhydride, phthalic anhydride, hexahydrophthalic anhydride and methylated hexahydrophthalic anhydride, etc., vinyl monomers which include a hydroxyl group, such as 2-hydroxyethyl (meth)acrylate, 2-hydroxypropyl (meth)acrylate, 3-hydroxypropyl (meth) acrylate, 4-hydroxybutyl (meth)acrylate and butane-1,4-diol mono(meth)acrylate, etc., monoethers of hydroxyl-group-containing vinyl monomers above with polyether polyols such as polyethylene glycol and polypropylene glycol, etc., anti vinyl monomers which include an epoxy group, such as glycidyl (meth)acrylate and 3,4-epoxycyclohexylmethyl (meth)acrylate, etc. These can be employed singly or combinations of 2 or more can be employed.

The proportion of vinyl monomer having a ring structure in the total quantity of monomers which are copolymerized is 20–50 wt %, and preferably 25–45 wt %, and the proportion of other monomers is 80–50 wt %, and preferably 75–55 wt %.

With a proportion of less than 20 wt % of monomer having a cyclic structure the acid resistance of the resulting paint films is inadequate, and more than 50 wt % is undesirable because adhesion between the base finishing coat and top finishing coat is lowered.

Polymerization initiators used in this aforementioned copolymerization include t-butyl peroxybenzoate and t-butyl peroxy-2-ethylhexanoate, etc.; the quantity employed is 0.01–4 parts by weight, and preferably 0.2–2.7 parts by weight, to 100 parts by weight of total monomer.

The aforementioned copolymerization is performed at a temperature ordinarily of 90–170° C., and preferably 100–150° C., and the reaction time is ordinarily 3–8 hours, and preferably 4–6 hours.

As a reaction medium an organic solvent such as xylene, hexane or toluene, etc., can be employed.

The transition temperature of the principal resin of the top finishing coat is 0 to +60° C., and preferably 0 to +50, and more preferably 5 to +55° C. With less than 0° C. the acid resistance of the resulting paint films is inadequate, and more than 60° C. is undesirable because finished appearance is lowered due to poor smoothness.

Similarly, the solubility parameter of the principal resin of the top finishing coat is 9.0–11.0, and preferably 9.5–10.5, and more preferably 9.8–10.5. With less than 9.0 the gasoline resistance of the resulting films is inadequate, and more than 11.0 is undesirable because finished appearance and water resistance are lowered.

Moreover, the weight-average molecular weight of the principal resin of the top finishing coat is 4000–30,000, and preferably 5000–25,000, and more preferably 7000–22,000. With a weight-average molecular weight less than 4000 weather resistance is inadequate, and more than 30,000 is undesirable because the paint is not sufficiently fine, and the finished appearance of the paint films is lowered.

There are no specific restrictions as to the mode of curing top finishing coats which include a principal resin described above, i.e. the combination of principal resin and hardener, and all systems which can be employed for painting automobiles can be used, such as a hydroxyl-group-containing resin/melamine resin system, hydroxyl-group-containing resin/isocyanate system, hydroxyl-group-containing resin/blocked isocyanate system, carboxyl-group-containing resin/epoxy system, epoxy-group-containing resin/carboxyl-group-containing resin, or silicone crosslinking, etc., for example. These modes can be used on their own, or in combinations of 2 or more.

Hydroxyl-group-containing acrylic resins obtained by copolymerizing at least a vinyl monomer having a ring structure as already described, such as styrene, etc., for example, and a hydroxyl-group-containing monomer such as 2-hydroxyethyl (meth)acrylate, etc., for example, as essential monomers, with other vinyl monomers, can be employed as aforementioned hydroxyl-group-containing principal resins. It should be noted that the vinyl monomer having a ring structure, the hydroxyl-group-containing vinyl monomer and the other vinyl monomers can each be single monomers or combinations of 2 or more monomers.

Carboxyl-group-containing resins obtained by copolymerizing at least a vinyl monomer having a ring structure as already described, such as styrene, etc., for example, and a carboxyl-group-containing monomer such as acrylic acid, etc., for example, as essential monomers, with other vinyl monomers can be employed as aforementioned carboxyl-group-containing principal resins. It should be noted that the vinyl monomer having a ring structure, the carboxyl-group-containing vinyl monomer and the other vinyl monomers can each be single monomers or combinations of 2 or more monomers.

Epoxy-group-containing resins obtained by copolymerizing at least a vinyl monomer having a ring structure as already described, such as styrene, etc., for example, and a epoxy-group-containing monomer such as glycidyl (meth) acrylate, etc., for example, as essential monomers, with other vinyl monomers, can be employed as aforementioned epoxy-group-containing principal resins. It should be noted that the vinyl monomer having a ring structure, the epoxy-group-containing vinyl monomer and the other vinyl monomers can each be single monomers or combinations of 2 or more monomers.

As aforementioned hardeners the same ones mentioned previously as hardeners for the base finishing coat can be employed.

Polymers such as acrylic polymers, polyester polymers, urethane polymers, non-aqueous dispersions of acrylic polymers and crosslinked polymer particles, etc., and additives employed in prior paint, including colorings such as pigments and dyes, etc., pigment dispersants, viscosity adjusting agents, sag preventing agents, levelling agents, hardening catalysts, gel-preventing agents, ultraviolet absorbers and free radical scavengers, etc., can also optionally be added to the top finishing coat used in the present invention, within ranges that do not detract from the purpose of the present invention.

In the majority of cases the top finishing coat used in the present invention will be used as a clear coat; however, it can also be used in the form of a semi-transparent or opaque paint by adding a large quantity of coloring.

If necessary, an organic solvent can also be used in top finishing coat paints used in the present invention; an aromatic hydrocarbon solvent, ester solvent, ketone solvent or alcohol solvent, etc., can be employed as this organic solvent.

In the present invention an aforementioned solvent-based base finishing coat and top finishing coat are painted wet-on-wet, i.e. the top finishing coat is painted on the unhardened base finishing coat paint film, and hardened by heating simultaneously in 2 coats/1 bake.

In a specific painting method, an aforementioned base finishing coat paint is first adjusted to a viscosity of the order of 10–13 seconds (Ford cup No. 4/20° C.), and this solvent-based base finishing coat paint is coated onto the surface of the object to be painted. For this it is desirable to paint using a spray coater, such as an air spray coater, an airless spray coater or a Ransburg No. 1 or Ransburg No. 2 type electrostatic spray coater, etc., for example to give a dry film thickness of the order of 10–30 μm, and preferably 15–20 μm.

After coating with a solvent-based base finishing coat paint in this way, the object to be painted is left for several minutes at ordinary temperature, and then an aforementioned top finishing coat paint adjusted to a viscosity of the order of 15–50 seconds (Ford cup No. 4/20° C.) is coated onto the painted surface using a conventional spray coater such as an air spray coater, an airless spray coater or a Ransburg No. 1 or Ransburg No. 2 type electrostatic spray coater, etc., for example to give a dry film thickness of the order of 20–50 μm, and preferably 25–45 μm. After then taking a setting time of the order of 5–30 minutes to make the paint film fully smooth and allow a certain degree of volatilization of the solvent in the films, both of the paint films above are hardened by heating at a temperature of 100–180° C., and preferably 120–160° C., for 10–120 minutes, and preferably 30–60 minutes, using a hot air oven, and infrared furnace or an electric induction heating oven, etc., to form the desired hardened paint film.

There are no specific restrictions as to objects which can be painted using the method of the present invention for forming a paint film; examples of materials include iron, aluminum, zinc and alloys thereof, metals surface treated, etc., by iron phosphate treatment, zinc phosphate or chromate treatment, etc., plastics such as polyurethane, polypropylene and polycarbonate, etc., and wood, etc. These objects to be painted can also have been painted with undercoat paint and middle coat paint, etc.

There are no specific restrictions as to the fields within which the method of the present invention for forming a paint film can be applied; however, its application for forming top finishing coat paint films on the outer bodywork of automobiles is particularly preferred.

Painted objects of the present invention are objects on which a paint film has been formed by the aforementioned method, and they have outstanding acid resistance, finished appearance, water resistance, adhesion, and bending resistance, etc. Paint films formed by the aforementioned method using a base finishing coat within the aforementioned ranges for glass transition temperature, solubility parameter and surface tension and a top finishing coat which is within the aforementioned ranges for glass transition temperature, solubility parameter and weight-average molecular weight, in which vinyl monomer having a ring structure is 20–50 wt %, in particular, are paint films which have outstanding recoat adhesion and gasoline resistance and even more outstanding finished appearance and water resistance.

With the present invention it is possible to form paint films of outstanding acid resistance, finished appearance, water resistance, adhesion and bending resistance, etc., when forming a paint film by coating a base finishing coat and a coat wet-on-wet, since a resin having specific properties is used as the principal resin of the top finishing coat. In addition, by using in combination with the top finishing coat a base finishing coat which includes as the principal resin a resin which has specified properties as the principal resin of the base finishing coat, it is possible to form paint films with outstanding recoat adhesion and gasoline resistance and even more outstanding finished appearance and water resistance. Moreover, with the present invention it is also possible to obtain painted objects which have such a paint film.

The present invention will next be explained in more detail by means of preparation examples, embodiments and comparison examples; however, the present example is not restricted in any way by these examples. In the different examples parts and percentages are based on weight.

PREPARATION EXAMPLE 1

Making Principal Resins for Base Finishing Coats and the Top Finishing Coats Five 4-mouthed flasks fitted with a thermometer, a stirrer, a reflux cooler, and a dropping funnel were prepared; the respective quantities of xylene recorded in Table 1 were put in, and the temperature was raised to 140° C. Then mixtures of the monomers and polymerization initiators recorded in Table 1 were added dropwise from the dropping funnel at an even speed over 2 hours. After finishing dropwise addition the system was held at reflux temperature, and the contents were cooled to 100° C. After cooling to 100° C. the polymerization initiator (added catalyst) in Table 1 was added dropwise at even speed over 30 minutes. The polymerization reaction was then completed by holding a temperature of 100° C. for a further 3 hours, to obtain solutions of copolymers A1–A5 which became the principal resins for base finishing coats, having the properties in Table 1.

Solutions of copolymers B1–B5 which became the principal resins for top finishing coats, having the properties in Table 2, were obtained as above, using the monomers recorded in Table 2.

TABLE 1

| | Base finishing coat copolymer | | | | |
|---|---|---|---|---|---|
| | A1 | A2 | A3 | A4 | A5 |
| Xylene (parts) | 96.5 | 96.5 | 96.5 | 96.0 | 96.5 |
| Added dropwise parts | | | | | |
| St *1 | 8.0 | 20.0 | 20.0 | 20.0 | 25.0 |
| MMA *2 | — | 5.0 | 46.5 | 29.2 | 46.5 |
| EHA *3 | — | — | — | 35.6 | — |
| BA *4 | 14.0 | — | — | — | — |
| EHMA *5 | — | — | 10.0 | — | — |
| LMA *6 | 40.0 | — | — | — | — |
| HEMA *7 | 7.0 | — | — | 13.9 | — |
| HEA *8 | — | 22.0 | — | — | 19.5 |
| 4HBA *9 | — | — | 9.5 | — | — |
| FM-4 *10 | 30.0 | — | 12.5 | — | 12.5 |
| AA *11 | 0.1 | 0.2 | 1.5 | 1.3 | 1.5 |
| MMA *12 | — | 3.0 | — | — | — |
| EA *13 | — | 29.8 | — | — | — |
| FM-1 *14 | — | 20.0 | — | — | — |
| t-BPBz *15 | 0.5 | 0.5 | 0.5 | 1.0 | 0.5 |
| Added Parts | | | | | |
| t-BPEH *16 | 0.1 | 0.1 | 0.1 | 0.2 | 0.1 |
| Xylene | 2.9 | 2.9 | 2.9 | 2.8 | 2.9 |
| Copolymer Properties | | | | | |
| Heating residue (%) *17 | 50 | 50 | 50 | 50 | 50 |
| Gardner viscosity (25° C.) *18 | T | U | W | U | V–W |
| Tg (° C.) *19 | −42 | +10 | +40 | 0 | +50 |
| Sp *20 | 10.02 | 11.45 | 10.98 | 10.20 | 10.97 |
| Surface tension (mN/m) *21 | 38 | 39 | 39 | 39 | 39 |
| OH value | 58.9 | 152.4 | 97.3 | 60 | 106 |
| Acid value | 7.8 | 21.1 | 11.7 | 10 | 7.8 |

Notes Table 1
*1 St : Styrene
*2 MMA : Methyl methacrylate
*3 EHA : 2-Ethylhexyl acrylate
*4 BA : n-Butyl acrylate TABLE 1-continued

| | Base finishing coat copolymer | | | | |
|---|---|---|---|---|---|
| | A1 | A2 | A3 | A4 | A5 |

*5 EHMA : 2-Ethylhexyl methacrylate
*6 LMA : Lauryl methacrylate
*7 HEMA : 2-Hydroxyethyl methacrylate
*8 HEA : 2-Hydroxyethyl acrylate
*9 4HBA : 4-Hydroxybutyl acrylate
*10 FM-4 : Plaxel FM4 (trade name Daicel Chemical Industries monomer addition product of 1 mol of 2-hydroxyethyl methacrylate and 4 mols of ϵ-capro-lactone)
*11 AA : Acrylic acid
*12 MA : Methacrylic acid
*13 EA : Ethyl acrylate
*14 FM-1 : Plaxel FM1 (trade name Daicel Chemical Industries monomer addition product of 1 mol of 2-hydroxyethyl methacrylate and 1 mol of ϵ-capro-lactone)
*15 t-BPBz : Polymerization initiator, t-butyl peroxy-benzoate
*16 t-BPEH : Polymerization initiator, t-butyl peroxy-ethylhexanoate
*17 Heating residue : According to JIS-K5407 4 "Heating residue"
*18 Gardner viscosity : According to JIS-K5400 4.5.1 "Gardner bubble viscosimetry"
*19 Tg (glass transition temperature) : Calculated by the aforementioned Equation (1) of T. G. Fox
*20 Calculated by the aforementioned method of Fedors using Equation (2)
*21 Determined by the aforementioned method using a ring type Dynometer (BYK Co.).

TABLE 2

| | Top finishing coat copolymer | | | | |
|---|---|---|---|---|---|
| | B1 | B2 | B3 | B4 | B5 |
| Xylene (parts) | 96.8 | 96.5 | 96.0 | 94.5 | 96.0 |
| Added dropwise parts | | | | | |
| CHMA *1) | 25.0 | 30.0 | 40.0 | 45.0 | 5.0 |
| MMA *2) | — | 10.0 | 18.7 | 26.5 | — |
| EHA *3) | 19.9 | 15.9 | 10.8 | — | 25.0 |
| tBMA *4) | 19.0 | 22.0 | 8.5 | — | 29.0 |
| EHMA *5) | — | — | — | 6.5 | 16.0 |
| HEA *6) | — | 20.7 | 20.7 | 20.7 | 20.7 |
| FM-1 *7) | 34.8 | — | — | — | — |
| AA *8) | 1.3 | 1.3 | 1.3 | 1.3 | 1.5 |
| t-BPBz *9) | 0.2 | 0.5 | 1.0 | 2.5 | 1.0 |
| Added Parts | | | | | |
| t-BPEH *10 | 0.2 | 0.2 | 0.2 | 0.2 | 0.2 |
| Xylene | 2.8 | 2.8 | 2.8 | 2.8 | 2.8 |
| Copolymer properties | | | | | |
| Heating residue (%) *11 | 50 | 50 | 50 | 50 | 50 |
| Mw *12 | 20000 | 16000 | 12000 | 8000 | 12000 |
| Tg (° C.) *13 | +5 | +25 | +35 | +55 | −8 |
| Sp *14 | 10.22 | 10.33 | 10.50 | 10.61 | 10.14 |
| OH value | 80 | 100 | 100 | 100 | 114 |
| Acid Value | 10 | 10 | 10 | 10 | 11.7 |

Notes Table 2
*1 CHMA : Cyclohexyl methacrylate
*4 tBMA : t-Butyl methacrylate
*12 Mw : Polystyrene equivalent determined by gel permeation chromatography
For *2, *3, *5–*11, *13 and *14 see Table 1
[0051]

PREPARATION EXAMPLES 2–6

Making Base Finishing Coat Paints

Base finishing coat paints were prepared by mixing the types and quantities of starting materials shown in Table 3 to form a dispersion.

TABLE 3

| Proportions included | Preparation Examples | | | | |
|---|---|---|---|---|---|
| (parts) | 2 | 3 | 4 | 5 | 6 |
| Copolymer solution A1 | 130.0 | — | — | — | — |
| Copolymer solution A2 | — | 130.0 | — | — | — |
| Copolymer solution A3 | — | — | 130.0 | — | — |
| Copolymer solution A4 | — | | — | 130.0 | — |
| Copolymer solution A5 | — | | — | — | 130.0 |
| L-116-70 *1 | 21.4 | 21.4 | 21.4 | 21.4 | 21.4 |
| MG-1 dispersion *2 | 57.1 | 57.1 | 57.1 | 57.1 | 57.1 |
| Alumipaste *3 | 15.4 | 15.4 | 15.5 | 15.4 | 15.4 |
| UV absorber solution *4 | 5.0 | 5.0 | 5.0 | 5.0 | 5.0 |
| Modaflow *5 | 0.3 | 0.3 | 0.3 | 0.3 | 0.3 |
| Isobutyl acetate | 10.0 | 10.0 | 10.0 | 10.0 | 10.0 |
| n-Butyl alcohol | 5.0 | 5.0 | 5.0 | 5.0 | 5.0 |

Notes Table 3
*1 Superbeckamin L-116-70 (trade name Dainippon Ink & Chemicals) isobutylated melamine resin solution (combustion residue 70%)
*2 Non-aqueous dispersion of organic crosslinked fine polymer particles (heating residue 50%, particles 35%)
*3 Alumipaste 7160N (trade name of an aluminum pigment made by Toyo Aluminium; heating residue 65%)
*4 10% xylene solution of Ciba-Geigy product Tinuvin 900
*5 Modaflow (trade name Monsanto, levelling agent)
[0054]

PREPARATION EXAMPLE 7

Making a Non-Aqueous Dispersion of Organic Crosslinked Fine Polymer Particles Made as follows by the method recorded in Preparation Example B1 of Japanese Unexamined Patent 1-279902.

| 1) Making a polymer aqueous dispersion | |
|---|---|
| Surfactant aqueous solution | |
| Deionized water | 380 parts |
| Lapisol B90 (Note 1) | 7.4 parts |
| Polymerization initiator aqueous solution 1 | |
| Deionized water | 10 parts |
| Sodium persulfate | 0.25 part |
| Particle-forming α,β-ethylenic unsaturated monomer mixture | |
| 2-Hydroxyethyl methacrylate | 1.2 part |
| Ethylene glycol dimethacrylate | 3 parts |
| Styrene | 15 parts |
| n-Butyl methacrylate | 80.8 parts |
| Polymerization initiator aqueous solution 2 | |
| Deionized water | 10 parts |
| Sodium persulfate | 0.25 part |

Note 1) Lapisol B90 (trade name of Nippon Oil & Fats disodium 2-ethylhexylsulfocuccinate; effective component 90%)

The surfactant aqueous solution above was loaded into a flask provided with a stirrer, a reflux cooler, dropping funnels (2), a tube for introducing nitrogen and a thermometer; the temperature was raised to 80° C. under a stream of nitrogen, and polymerization initiator aqueous solution 1 above was added. After the temperature reached 80° C. again, the temperature of the mixture inside the flask was held at 80±2° C. while the particle-forming α,β-ethylenic unsaturated monomer mixture was added over 3 hours. During the dropwise addition of this monomer mixture, 1 hour after starting dropwise addition, polymerization initiator aqueous solution 2 was added dropwise in 2 hours. After completing dropwise addition of the particle-forming α,β-unsaturated monomers and the polymerization initiator, polymerization was performed for a further 2 hours, to obtain a polymer aqueous dispersion.

2) Making a Polymer Non-Aqueous Dispersion 1000 parts of the polymer aqueous dispersion obtained above, 400 parts of methyl pentyl ketone and 45.3 parts of 3N aqueous sodium hydroxide were loaded into a flask provided with a stirrer, a reflux cooler, a dropping funnel and a thermometer; the temperature was raised to 85° C., and hydrolysis was performed at 85±2° C. The temperature was then lowered to 80° C., and after neutralization by adding 45.3 parts of aqueous hydrochloric acid, 143 parts of a solution of the acrylic resin of 3) below was added as a particle dispersion stabilizing resin; after stirring for 10 minutes, 50 parts of a 20% acetic acid triethylamine salt aqueous solution was added, stirring was stopped and on standing there was separation into an upper organic layer, in which polymer particles were dispersed, and a lower aqueous layer, and so the lower aqueous layer was discarded. 400 parts of deionized water was added to the remaining organic layer in which polymer particles were dispersed, and it was stirred as the temperature was raised to 70° C.; when 70° C. was reached, 25 parts of the 20% acetic acid triethylamine salt aqueous solution was added, and stirring was immediately stopped, followed by standing. Once again there was separation into 2 layers with the organic layer with dispersed polymer particles being the upper layer, and the lower layer being an aqueous layer, so the lower aqueous layer was discarded.

The temperature of the organic layer was then cooled to 50° C., and after adding 114 parts of methyl orthoformate over 30 minutes via the dropping funnel the reaction was continued at 50° C. for 30 minutes. After this, 200 parts of xylene was added, a chain-stack trap was fitted between the top of the reflux cooler and the flask and an aspirator was joined with the top of the reflux cooler, the flask was heated and stirred as the inside was evacuated, and 504 parts of solvent was distilled off under conditions of 300±100 mmHg and 80±10° C., to obtain a non-aqueous polymer dispersion. This non-aqueous dispersion, denominated MG-1, was employed in the preparation examples of Table 3.

3) Acrylic Resin 42 parts of xylene was loaded into a reaction vessel provided with a stirrer, a thermometer, a reflux cooler, a tube for introducing nitrogen and a dropping funnel, and when the temperature reached 140° C. a mixture of the monomer components and polymerization initiator shown below was added dropwise at a steady 140° C. from the dropping funnel at an even speed over 2 hours. After holding at 140° C. for a further 2 hours after dropwise addition, the contents were removed.

| | |
|---|---|
| n-Butyl methacrylate | 36.4 parts |
| 2-Ethylhexyl methacrylate | 11.7 parts |
| 2-Hydroxyethyl methacrylate | 11.1 parts |
| Acrylic acid | 0.8 part |
| t-Butyl peroxybenzoate | 3.0 parts |
| [0059] | |

PREPARATION EXAMPLES 8–12

Preparation of Top Finishing Coat Paints

Top finishing coat paints were prepared by dispersing the types and quantities of starting materials shown in Table 4 using a dissolver.

TABLE 4

| Proportions included (parts) | Preparation Examples 8 | 9 | 10 | 11 | 12 |
|---|---|---|---|---|---|
| Copolymer solution B1 | 140.0 | — | — | — | — |
| Copolymer solution B2 | — | 140.0 | — | — | — |
| Copolymer solution B3 | — | — | 140.0 | — | — |
| Copolymer solution B4 | — | | — | 140.0 | — |
| Copolymer solution B5 | — | | — | — | 140.0 |
| L-116-70 *1 | 28.6 | 28.6 | 28.6 | 28.6 | 28.6 |
| Takenate XB-72-G16 *2 | 16.7 | 16.7 | 16.7 | 16.7 | 16.7 |
| UV absorber *3 solution | 10.0 | 10.0 | 10.0 | 10.0 | 10.0 |
| Photostabilizer *4 solution | 10.0 | 10.0 | 10.0 | 10.0 | 10.0 |
| Modaflow *5 | 0.8 | 0.8 | 0.8 | 0.8 | 0.8 |
| Xylene | 10.0 | 10.0 | 10.0 | 10.0 | 10.0 |
| n-Butyl alcohol | 5.0 | 5.0 | 5.0 | 5.0 | 5.0 |

Notes Table 4

*2 Takenate XB-72-G16 (trade name Takeda Chemical Industries; solution of a non-yellowing blocked isocyanate compound, heating residue 80%)

*4 10% xylene solution of the Sankyo product Sanol LS292

*1, *3 and *5 see Table 3.

EMBODIMENTS 1–4 and COMPARISON EXAMPLES 1–2

Aqua No. 4200 (trade name Nippon oil & Fats, cationic electrocoating paint) was electrostatically coated onto zinc-phosphate-treated sheet steel to give a dry paint film thickness of 20 μm, and then it was stoved at 175° C. for 20 minutes. Haiepiko No. 100 (trade name Nippon oil & Fats, middle coat paint) was then air spray coated to give a dry paint film thickness of 40 μm, and stoved at 140° C. for 30 minutes to make a test sheet.

The base finishing coat paints of Preparation Examples 2–6 were diluted using a thinner (toluene/butyl acetate/isobutyl alcohol=50/30/20 w/w/w) to 13 seconds with Ford cup No. 4 (20° C.). similarly, the top finishing coat paints of Preparation Examples 8–12 were diluted using a thinner (Solvesso #100/n-butyl alcohol=70/30 w/w) to 25 seconds with Ford cup No. 4 (20° C.).

The diluted paints obtained were coated onto the aforementioned middle coated sheets in the combinations of Table 5. Thus, a base finishing coat paint was air spray coated in 2 stages with a 1 minute 30 second interval to give a hardened paint film of 15 μm, and after setting for 3 minutes at ordinary temperature a top finishing coat paint was coated on top by air spraying to give a hardened paint film thickness of 40 μm, and then stoved at 140° C. for 30 minutes to form a hardened paint film and give the completed test sheets.

TABLE 5

| | Embodiments 1 | 2 | 3 | 4 | Comparisons 1 | 2 |
|---|---|---|---|---|---|---|
| Base Coat (Preparation example) | 2 | 3 | 4 | 5 | 6 | 7 |
| Top Coat (Preparation example) | 8 | 9 | 10 | 11 | 8 | 12 |

TABLE 5-continued

| | Embodiments | | | | Comparisons | |
|---|---|---|---|---|---|---|
| | 1 | 2 | 3 | 4 | 1 | 2 |
| Test Result | | | | | | |
| Acid Resistance *1 | no abnormality | | | | no abnormality | considerable staining |
| Visual appearance *2 | good | | | | good | |
| 60° Mirror gloss *3 | 97 | 96 | 96 | 97 | 97 | 97 |
| Gasoline resistance *4 | no abnormality | | | | no abnormality | |
| Water resistance *5 | no abnormality | | | | no abnormality | |
| Primary adhesion *6 | no abnormality | | | | no abnormality | |
| Recoat adhesion *7 | no abnormality | | | | paint film detachment | no abnormality |
| Bending resistance *8 | no abnormality | | | | no abnormality | |

Notes Table 5

*1 Acid resistance : 0.2 ml of 5.5 mol/l sulfuric acid aqueous solution was spotted onto the test sheet, which was heated at 60° C. for 15 minutes and then washed with water, and the degree to which stain streaks were produced was assessed visually.

*2 Visual appearance : The smoothness, shrinkage and luster of the paint film were assessed visually.

*3 60° mirror surface gloss : According to JIS K-5400 7.6. "60° mirror surface gloss"

*4 Gasoline resistance : Blistering, discoloration and detachment of the paint film were assessed visually after immersion for 7 hours in regular gasoline at 20° C.

*5 Water resistance : By the water-resistance test of JIS K-5400 8.19

*6 Primary adhesion : By the adhesion test of JIS K-5400 8.5

*7 Recoat adhesion : After coating twice with base finishing coat paint and top finishing coat paint in 2 coats/1 bake by the aforementioned coating method (stoving conditions 140° C. × 30 minutes twice), 2-mm cross-hatching was performed following the adhesion test of JIS K-5400 8.5, and the state of detachment of the paint film was observed.

*8 Bending resistance : The state of detachment of the film after performing the bending resistance test of JIS K-5400 (1990) 8.1, with a mandrel of 10 mm.

From the results of Table 5 it is evident that the painted objects of Embodiments 1–4 obtained by the method of the present invention for forming paint films all had outstanding acid resistance, finished appearance and water resistance, and also had outstanding bending resistance and adhesion. By contrast, with Comparison Example 1 recoat adhesion was poor because the glass transition temperature of the acrylic resin (principal resin) used in the base finishing coat exceeded +40° C. Similarly, with Comparison Example 2 acid resistance was poor because the proportion of vinyl monomer having a ring structure in the copolymer of the acrylic resin (principal resin) used in the top finishing coat was less than 20 wt %, and the glass transition temperature of the acrylic resin was less than 0° C.

What is claimed is:

1. A method for forming a hardened paint film, comprising the steps of:

painting a solvent-based thermosetting base finishing coat onto the surface of an object to be painted, painting a thermosetting top finishing coat on top of the solvent based thermosetting base finishing coat wet-on-wet, and hardening the resulting paint films at the same time, wherein the thermosetting top finishing coat comprises a principal resin comprising a copolymer of a first vinyl monomer which has an aliphatic ring structure and other vinyl monomer(s) other than silicon monomers, in which the proportion of said first vinyl monomer in the total quantity of monomers is 20–50 wt %, and the proportion of other vinyl monomer(s) is 80–50 wt %, and which has a glass transition temperature of 0 to +60° C., a solubility parameter of 9.0–11.0, and a weight-average molecular weight of 4000–30,000.

2. The method for forming a paint film of claim 1, wherein the base finishing coat comprises a principal resin comprising a resin having a glass transition temperature of −50 to +40° C., a solubility parameter of 10.0–12.0 and a surface tension of 30–50 mN/m.

3. A painted object obtained by the method of claim 1.

4. A method of forming a hardened paint film, comprising the steps of:

a) applying a solvent-based thermosetting base finishing coat onto a surface of an object to be painted;

b) applying a thermosetting top finishing coat on top of the solvent-based thermosetting base finishing coat wet-on-wet; and c) simultaneously hardening the base finishing coat and the top finishing coat by heating at a temperature in a range from 100–180 degrees C for a period in a range from 10–120 minutes;

wherein the thermosetting top finishing coat comprises a principal resin comprising a copolymer of a first vinyl monomer which includes an aliphatic ring structure, and one or more additional vinyl monomers other than silicon monomers, in which the proportion of the first vinyl monomer in the total quantity of monomers is in a range from 20 to 50 weight percent, and the proportion of the additional vinyl monomers is in a range from 50 to 80 weight percent;

and further wherein the principal resin copolymer has a glass transition temperature in a range from 0 to 60 degrees C, a solubility parameter in a range from 9.0 to 11.0, and an average molecular weight in a range from 4,000 to 30,000.

5. The method of claim 4, wherein the first vinyl monomer comprises a component selected from the group consisting of cyclohexyl (meth)acrylate, isobornyl (meth)acrylate, tetracyclo dodecyl-3-(meth)acrylate, adamantyl (meth) acrylate, 2-methacryloyloxyethylhexahydrophthalic acid, and mixtures thereof.

6. The method of claim 4, wherein the first vinyl monomer is present in a range from 25 to 45 weight percent of the total quantity of monomers.

7. The method of claim 4, wherein the hardening step is accomplished by heating at a temperature in a range from 120–160 degrees C for a period in a range from 30–60 minutes.

* * * * *